US006394074B1

(12) United States Patent
Okada et al.

(10) Patent No.: US 6,394,074 B1
(45) Date of Patent: May 28, 2002

(54) VAPOR FUEL PROCESSING SYSTEM HAVING CANISTER FOR ABSORBING VAPOR FUEL CONTAINED IN FUEL TANK

(75) Inventors: Kingo Okada, Toyohashi; Nobuhiko Koyama, Nagoya; Toshihiko Muramatsu, Chiryu; Susumu Kojima, Susono, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/978,582

(22) Filed: Oct. 18, 2001

(30) Foreign Application Priority Data

Oct. 20, 2000 (JP) ..... 2000-320835

(51) Int. Cl.[7] ..... F03M 37/04
(52) U.S. Cl. ..... 123/519; 123/516
(58) Field of Search ..... 123/525, 521, 123/516, 518, 519, 520, 522

(56) References Cited

U.S. PATENT DOCUMENTS 4,059,081 A * 11/1977 Kayanuma ..... 123/520
4,829,968 A * 5/1989 Onufer ..... 123/518
5,275,145 A 1/1994 Tuckey
5,931,141 A * 8/1999 Chino ..... 123/516
6,014,958 A * 1/2000 Miwa et al. ..... 123/520

FOREIGN PATENT DOCUMENTS

JP 58-136660 9/1983

* cited by examiner

*Primary Examiner*—Carl S. Miller
(74) *Attorney, Agent, or Firm*—Nixon & Vanderhye P.C.

(57) ABSTRACT

A fuel pump suctions fuel from a fuel tank and discharges it into a pressure tank. Then, the fuel pump suctions the fuel from the pressure tank and pressurizes it. Then, the fuel pump discharges the pressurized fuel toward an engine side through a fuel discharge pipeline. A pressure control valve is opened to communicate an inside of the fuel tank and an inside of the pressure tank when a pressure in the pressure tank becomes equal to or greater than a predetermined pressure. A canister receives activated carbons for absorbing vapor fuel from the fuel tank. A pressurizing pump suctions the vapor fuel from the canister and pressurizes it. The pressurized vapor fuel is then discharged from the pressurizing pump into the pressure tank, so that the vapor fuel is dissolved into the fuel in the pressure tank.

9 Claims, 3 Drawing Sheets

VAPOR FUEL PROCESSING SYSTEM HAVING CANISTER FOR ABSORBING VAPOR FUEL CONTAINED IN FUEL TANK

CROSS REFERENCE TO RELATED APPLICATION

This application is based on and incorporates herein by reference Japanese Patent Application No. 2000-320835 filed on Oct. 20, 2000.

BACKGROUND OF THE INVENTION

1. Field of the Invention

The present invention relates to a vapor fuel processing system for dissolving vapor fuel, which is generated in a fuel tank and is absorbed by a canister, into liquid fuel received in the fuel tank.

2. Description of Related Art

In a previously proposed vapor fuel processing system, vapor fuel generated in the fuel tank is absorbed by activated carbons received within a canister and is discharged into an intake air pipeline of an intake air system that supplies intake air to an engine, so that the vapor fuel discharged into the intake air pipeline is combusted in the engine. However, in this system, a deviation in an air-fuel ratio occurs due to the vapor fuel discharged into the intake air pipeline. This may result in an increase in the amount of noxious components contained in exhaust gas of the vehicle. This is not favorable for satisfying various emission standards, such as the SULEV standard. Thus, it is desirable to reduce the amount of the vapor fuel discharged into the intake air pipeline.

Furthermore, there is a strong demand for improving fuel consumption of vehicles. In an engine that can achieve improved fuel consumption, a negative pressure of intake air is reduced due to a reduction in a pumping loss and an increase in fuel combustion in a lean fuel range. In the engine that has the reduced negative pressure of the intake air, the amount of the vapor fuel, which is absorbed by the canister and is then removed from the canister into the intake air pipeline through use of the negative pressure of the intake air, is reduced.

The system that discharges the vapor fuel into the intake air system can be modified as follows. That is, the vapor fuel absorbed by the canister from the fuel tank may be suctioned into and pressurized within a pressurizing pump. Then, the pressurized vapor fuel may be discharged into a pressure tank maintained at a high pressure to liquefy the vapor fuel. Thereafter, the liquefied fuel under the high pressure may be discharged into a fuel supply line.

However, when the pump suctions the vapor fuel from the canister, the air is also suctioned along with the vapor fuel, so that the air is also dissolved into the pressurized liquefied fuel. Thus, the fuel that contains the dissolved air is supplied to the engine. When the fuel pressure decreases, for example, right after engine stop, the air dissolved in the fuel is depressurized and becomes air bubbles, making it difficult to restart the engine.

SUMMARY OF THE INVENTION

Thus, it is an objective of the present invention to provide a vapor fuel processing system that can process vapor fuel regardless of a degree of a negative pressure of intake air and can restrain a deviation in an air-fuel ratio.

To achieve the objective of the present invention, there is provided a vapor fuel processing system including a fuel tank, a pressure tank, a pressure control valve, a canister and a pressurizing pump. The fuel tank receives liquid fuel. The pressure tank is arranged within the fuel tank and receives liquid fuel supplied from the fuel tank. The pressure control valve is arranged between the fuel tank and the pressure tank. The pressure control valve is opened to communicate between an inside of the pressure tank and an inside of the fuel tank when a pressure within the pressure tank becomes equal to or greater than a predetermined pressure. The canister absorbs vapor fuel contained in the fuel tank. The pressurizing pump is arranged between the canister and the pressure tank. The pressurizing pump suctions the vapor fuel from the canister and discharges the vapor fuel into the liquid fuel in the pressure tank upon pressurizing the vapor fuel in the pressurizing pump to dissolve the vapor fuel into the liquid fuel in the pressure tank.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Various embodiments of the present invention will be described with reference to the accompanying drawings.

First Embodiment

Figure 1:
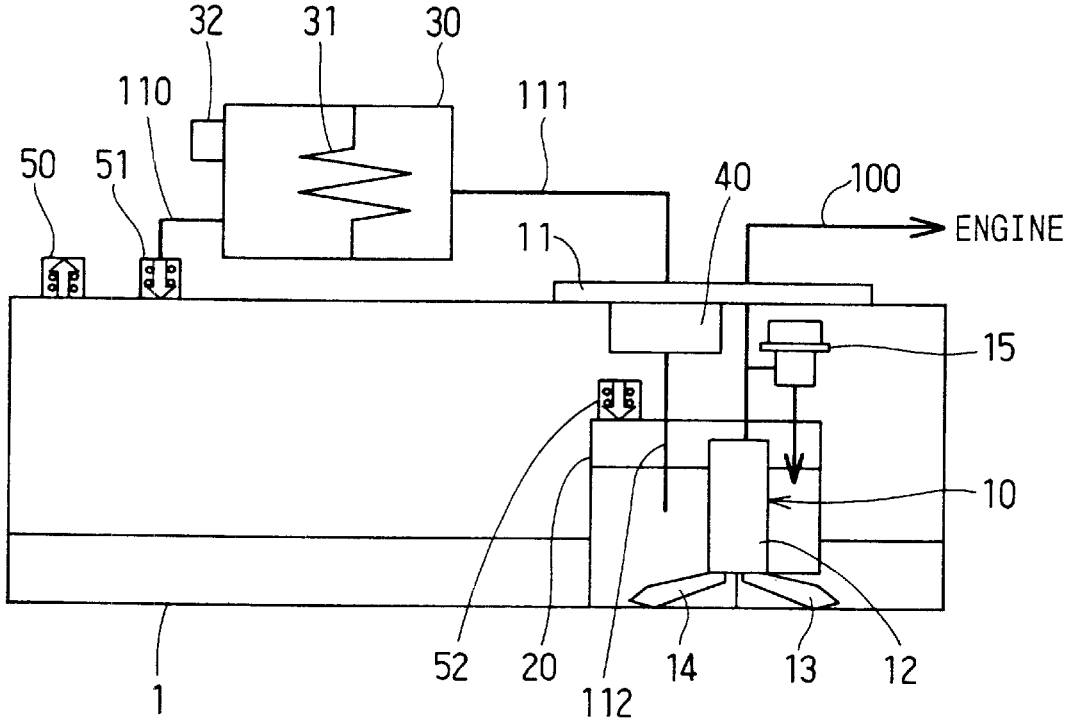
FIG. 1 is a schematic view of a vapor fuel processing system according to a first embodiment of the present invention.

A vapor fuel processing system according to a first embodiment of the present invention is shown in FIG. 1.

There is provided a fuel tank 1 that can be made of a resin material or a metal material. A pressure control valve 50 is provided within the fuel tank 1. When a pressure in the fuel tank 1 becomes negative, the pressure control valve 50 is opened to connect an inside and an outside of the fuel tank 1.

The fuel pump 10 is an in-tank type fuel pump that is received within the fuel tank 1. The fuel pump 10 includes a flange 11, a pump main body 12, suction filters 13, 14 and a pressure regulator 15. The flange 11 is attached to the fuel tank 1. Various fuel pipelines, connectors and the like are attached to the flange 11. Furthermore, a pressurizing pump 40, which will be described later in greater detail, is integrally mounted to the flange 11. Thus, the fuel pump 10 and the pressurizing pump 40 constituting an integrated unit that may be preassembled before it is installed in the fuel tank 1. The integrated unit allows easier assembly of the vapor fuel processing system and also allows a reduction in the number of the assembling steps for assembling the vapor fuel processing system.

The pump main body 12 is of a two-stage type. In a first stage, the pump main body 12 suctions fuel from the fuel tank 1 through the suction filter 13 and discharges it into a pressure tank 20. Then, in a second stage, the pump main body 12 suctions the fuel from the pressure tank 20 through the suction filter 14 and pressurizes it. Then, the pump main body 12 discharges the pressurized fuel toward an engine side of the system through a fuel discharge pipeline 100. A pressure regulator 15 regulates a pressure of the pressurized fuel discharged from the pump main body 12 to be equal to or less than a predetermined value. The pressure regulator 15 also returns excess fuel into the pressure tank 20. The pressure tank 20 is substantially sealed. A pressure control valve 52 is opened to communicate between the inside of the fuel tank 1 and an inside of the pressure tank 20 when a pressure in the pressure tank 20 becomes equal to or greater than a predetermined pressure.

A canister 30 is arranged at the outside of the fuel tank 1 and receives activated carbons for absorbing vapor fuel outputted from the fuel tank 1. The canister 30 has a heater 31 and a solenoid valve 32. The heater 31 that acts as a heating means of the present invention heats an inside of the canister 30 to increase the amount of fuel removed from the activated carbons of the canister 30. When the solenoid valve 32 is opened, the inside and an outside of the canister 30 are communicated with each other, so that the inside of the canister 30 is communicated with the atmosphere. A pipeline 110 connects between a pressure control valve 51 provided in the fuel tank 1 and the canister 30. The pressure control valve 51 opens to communicate between the inside of the fuel tank 1 and the inside of the canister 30 when the pressure in the fuel tank 1 becomes equal to or greater than a predetermined pressure. A pipeline 111 connects between the canister 30 and the pressurizing pump 40. A pipeline 112 connects between the pressurizing pump 40 and the pressure tank 20. The pipelines 110, 111, 112 constitute a circulation pipeline for circulating air received in the fuel tank 1 between the fuel tank 1 and the canister 30.

The pressurizing pump 40 is assembled to the flange 11. The pressurizing pump 40 is driven, for example, by a motor to suction the vapor fuel received in the canister 30 and to pressurize it to a pressure equal to or less than 100 kPa. The pressurized vapor fuel is then discharged from the pressurizing pump 40 into the pressure tank 20.

In general, in order to liquefy the vapor fuel, the vapor fuel should be cooled to about zero degrees Celsius or should be pressurized to about 500 to 600 kPa. In the present embodiment, the vapor fuel is absorbed by the canister 30 when it is supplied from the fuel tank 1 through the pipeline 110, and then the vapor fuel is suctioned from the canister 30 by the pressurizing pump 40 through the pipeline 111. Thereafter, the vapor fuel is pressurized by the pressurizing pump 40 and is discharged into the pressure tank 20 through the pipeline 112, so that the vapor fuel is dissolved into the liquid fuel received in the pressure tank 20. The vapor fuel dissolved into the liquid fuel received in the pressure tank 20 is suctioned by the pump main body 12 and is thereafter discharged from the pump main body 12 toward the engine side of the system. The air discharged into the pressure tank 20 along with the vapor fuel is discharged into the fuel tank 1 through the pressure control valve 52 and flows into the canister 30 along with the remaining air and the vapor fuel in the fuel tank 1 once again.

When the vapor fuel is pressurized to about equal to or less than 100 kPa without cooling it, the most of the vapor fuel can be dissolved into the liquid fuel in the pressure tank 20 without cooling it. This allows use of a smaller pressurizing pump having a smaller pressurizing capacity as the pressurizing pump 40 of the present embodiment. Furthermore, it is also possible to prevent leakage of the vapor fuel out of the fuel tank 1.

In the present embodiment, the temperature in the canister 30 is raised by the heater 31. The removal process of the vapor fuel absorbed by the activated carbons in the canister 30 is an endothermic reaction. Thus, when the temperature of the canister 30 increases, the amount of the vapor fuel removed from the canister 30 increases, so that a concentration of the vapor fuel discharged into the pressure tank 20 increases. When the concentration of the vapor fuel discharged into the pressure tank 20 increases, the vapor fuel is more easily dissolved into the liquid fuel received within the pressure tank 20.

When the temperature inside of the fuel tank 1 rises, a concentration of the vapor fuel supplied to the canister 30 tends to increase. Thus, it is advantageous to provide, for example, a cooling device at an inlet side of the pressure control valve 51 to reduce a temperature of the air in order to reduce the concentration of the vapor fuel supplied to the canister 30.

Also, when the amount of the vapor fuel removed from the canister 30 increases, the amount of the vapor fuel that can be absorbed by the canister 30 increases. Thus, a size of the canister according to the present embodiment can be advantageously reduced in comparison to a canister that is not heated while a capacity of the canister for absorbing the vapor fuel is maintained at substantially the same level.

Second Embodiment

Figure 2:
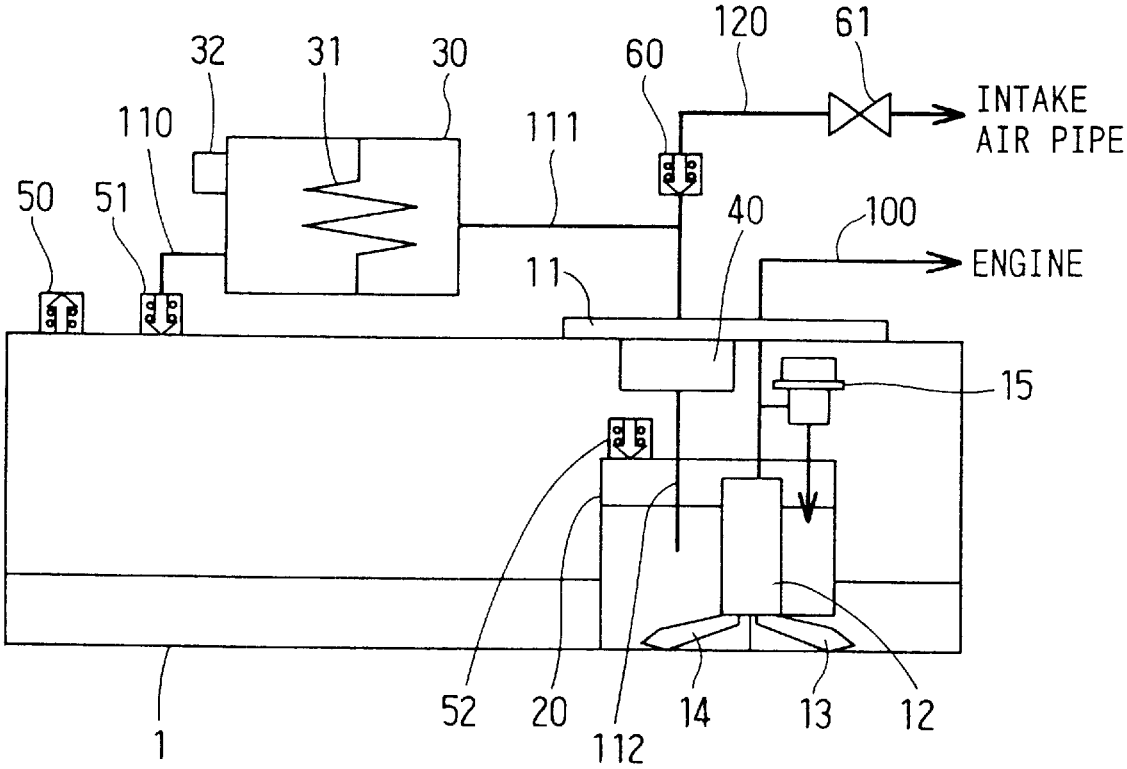
FIG. 2 is a schematic view of a vapor fuel processing system according to a second embodiment of the present invention.

A second embodiment of the present invention is shown in FIG. 2. Components similar to those of the first embodiment are depicted with similar reference numerals. In the second embodiment, in addition to the passage for discharging the vapor fuel from the canister 30 into the pressure tank 20, there is also provided a passage for discharging the vapor fuel from the canister 30 into an intake air pipeline that constitutes a part of an intake air system.

A pipeline (output pipeline) 120 branches off from the pipeline 111 and is connected to the intake air pipeline (not shown). A check valve 60 is inserted in the pipeline 120 on the canister 30 side. The check valve 60 prevents backflow of the vapor fuel from the intake air pipeline side toward the canister 30 side thereof. A solenoid valve 61 is inserted in the pipeline 120 on the intake air pipeline side of the check valve 60. When the solenoid valve 61 is opened, the canister 30 side is communicated with the intake air pipeline side, so that the vapor fuel within the canister 30 is discharged to the intake air pipeline side. The pipeline 120 and the solenoid valve 61 constitute an outputting means of the present invention.

When an ambient temperature rises, and thereby a large amount of the vapor fuel is generated in the fuel tank 1, it could happen that the pressurizing pump 40 alone is not sufficient to process the vapor fuel within the canister 30 by discharging the vapor fuel into the pressure tank 20. When a pressure sensor (not shown) senses that the pressure inside of the fuel tank 1 becomes equal to or greater than a predetermined pressure, the solenoid valve 61 is opened, so that the vapor fuel that has not been discharged into the pressure tank 20 by the pressurizing pump 40 is discharged to the intake air pipeline side.

The amount of the vapor fuel discharged into the intake air pipeline side should be small, so that a deviation in an air-fuel ratio is small. Furthermore, by opening the solenoid valve 61, the vapor fuel is processed through the two systems, so that the amount of the vapor fuel removed from the canister 30 is increased, and thereby the amount of the vapor fuel that can be absorbed by the canister 30 is increased. Thus, a size of the canister can be further reduced in comparison to the canister of the first embodiment while the amount of the vapor fuel that can be absorbed by the canister remains substantially the same. Furthermore, depending on the amount of the vapor fuel generated in the fuel tank 1, it is possible to eliminate the heater 31.

Third Embodiment

Figure 3:
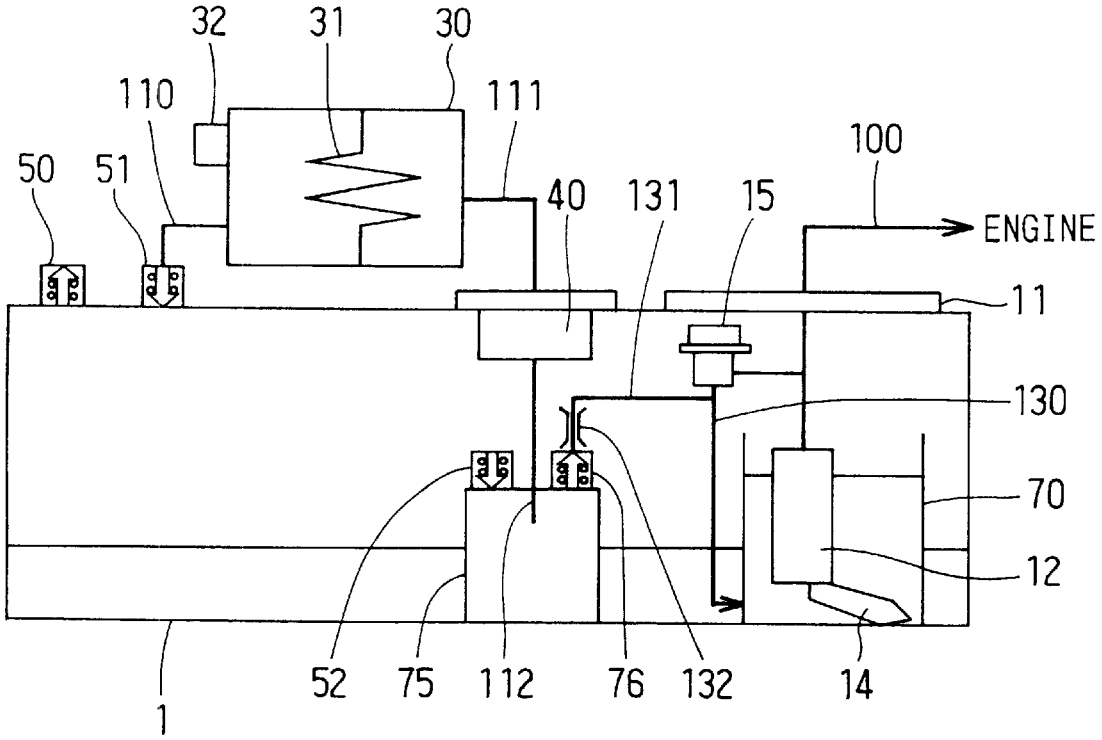
FIG. 3 is a schematic view of a vapor fuel processing system according to a third embodiment of the present invention.

A third embodiment of the present invention is shown in FIG. 3. Components similar to those of the first embodiment are depicted with similar reference numerals. In the third embodiment, a subtank 70 and a pressure tank 75 are provided as separate components. The pump main body 12 suctions the fuel from the subtank 70, and the vapor fuel pressurized by the pressurizing pump 40 is discharged into the pressure tank 75.

A known jet pump (not shown) is connected to a distal end of a pipeline 130 for circulating the excess fuel from the pressure regulator 15. A fuel level in the subtank 70 is maintained to be higher than a fuel level in the fuel tank 1 by the fuel injected through the jet pump.

The fuel circulated from the pressure regulator 15 is also circulated to the pressure tank 75 through a pipeline 131. A choke 132 is provided in the pipeline 131. By adjusting an opening area of the choke 132, a ratio between the amount of the fuel to be circulated to the jet pump and the amount of the fuel to be circulated to the pressure tank 75 can be adjusted. The fuel circulated to the pipeline 131 flows into the pressure tank 75 from the choke 132 through a check valve 76. The check valve 76 prevents backflow of the fuel from the pressure tank 75 to the pressure regulator 15 side, so that the check valve 76 maintains a pressure in the pressure tank 75 when the engine is stopped.

As described above, in each one of the above embodiments, the vapor fuel is dissolved into the liquid fuel in the pressure tank. Thus, substantially no vapor fuel is discharged to the engine side, or only a small amount of the vapor fuel is discharged to the engine side, if any. Thus, even if the air-fuel ratio is deviated, the amount of the deviation in the air-fuel ratio can be minimized, so that noxious components contained in exhaust gas of the vehicle can be accordingly reduced.

Furthermore, the vapor fuel can be processed regardless of a degree of a negative pressure of the intake air, so that fuel consumption can be improved. Thus, if the vapor fuel processing system of the present invention is implemented in a low emission engine that has a smaller pumping loss and a wider lean fuel range, the vapor fuel can be effectively processed, so that the amount of the noxious components contained in the exhaust gas can be relatively easily reduced.

In the above embodiments of the present invention, although the fuel pump is received within the fuel tank 1, it is possible to arrange the fuel pump at the outside of the fuel tank 1. Furthermore, the pressurizing pump and the pressure tank can be also arranged at the outside of the fuel tank 1.

Additional advantages and modifications will readily occur to those skilled in the art. The invention in its broader terms is therefore, not limited to the specific details, representative apparatus, and illustrative examples shown and described.

What is claimed is:

1. A vapor fuel processing system comprising:

a fuel tank for receiving liquid fuel;

a pressure tank arranged within said fuel tank, said pressure tank receiving liquid fuel supplied from said fuel tank;

a pressure control valve arranged between said fuel tank and said pressure tank, said pressure control valve being opened to communicate between an inside of said pressure tank and an inside of said fuel tank when a pressure within said pressure tank becomes equal to or greater than a predetermined pressure;

a canister for absorbing vapor fuel contained in said fuel tank; and a pressurizing pump arranged between said canister and said pressure tank, said pressurizing pump suctioning said vapor fuel from said canister and discharging said vapor fuel into said liquid fuel in said pressure tank upon pressurizing said vapor fuel in said pressurizing pump to dissolve said vapor fuel into said liquid fuel in said pressure tank.

2. A vapor fuel processing system according to claim 1, further comprising a heating means arranged within said canister for heating an inside of said canister.

3. A vapor fuel processing system according to claim 1, further comprising an outputting means for outputting said vapor fuel absorbed within said canister to an intake air system.

4. A vapor fuel processing system according to claim 1, further comprising a fuel pump received within said fuel tank, said fuel pump pumping said liquid fuel received within said fuel tank toward an engine side of said vapor fuel processing system.

5. A vapor fuel processing system according to claim 4, wherein said pressurizing pump and said fuel pump are provided together as an integrated unit.

6. A vapor fuel processing system according to claim 1, wherein said canister is inserted in a circulation pipeline that circulates air received within said fuel tank between said fuel tank and said canister, said vapor fuel absorbed by said canister being removed from said canister with use of said air circulated through said circulation pipeline.

7. A vapor fuel processing system according to claim 3, wherein said outputting means including:

an output pipeline arranged between said canister and said intake air system to communicate therebtween; and a solenoid valve inserted in said output pipeline, said solenoid valve being opened when a pressure in said fuel tank becomes equal to or greater than a predetermined pressure.

8. A vapor fuel processing system according to claim 4, wherein said fuel pump includes a pump main body received within said pressure tank.

9. A vapor fuel processing system according to claim 4, wherein said fuel pump includes a pump main body arranged at an outside of said pressure tank.

* * * * *

UNITED STATES PATENT AND TRADEMARK OFFICE

CERTIFICATE OF CORRECTION

PATENT NO. : 6,394,074 B1
APPLICATION NO. : 09/978582
DATED : May 28, 2002
INVENTOR(S) : K. Okada et al.

It is certified that error appears in the above-identified patent and that said Letters Patent is hereby corrected as shown below:

Title Page:

On first page format of above patent at item [73], please insert the additional assignee:

--TOYOTA JIDOSHA KABUSHIKI KAISHA, Toyota-city, Japan--

Signed and Sealed this

Fourth Day of March, 2008

JON W. DUDAS
*Director of the United States Patent and Trademark Office*